United States Patent [19]

Lockwood

[11] Patent Number: 4,575,699

[45] Date of Patent: Mar. 11, 1986

[54] DIELECTRIC RESONATOR FREQUENCY SELECTIVE NETWORK

[75] Inventor: Larry R. Lockwood, McMinnville, Oreg.

[73] Assignee: Tektronix, Inc., Beaverton, Oreg.

[21] Appl. No.: 674,208

[22] Filed: Nov. 23, 1984

[51] Int. Cl.[4] ..... H01P 7/10; H01P 5/02

[52] U.S. Cl. ..... 333/219; 333/202; 333/230; 333/245

[58] Field of Search ..... 333/202, 204–206, 333/208–212, 219–235, 245, 246; 331/107 DP, 107 SL

[56] References Cited

U.S. PATENT DOCUMENTS 4,288,761 9/1981 Hopfer ..... 333/238

*Primary Examiner*—Marvin L. Nussbaum

*Attorney, Agent, or Firm*—William A. Birdwell; Francis I. Gray

[57] ABSTRACT

A dielectric resonator frequency selective network. A frequency selective network for microwave circuits is provided whereby a dielectric resonator is coupled to associated circuitry by input and output coupling loops formed in a single circuit board. The two loops are closely spaced, but partially overlapping at a position such that they are substantially decoupled from one another. A dielectric resonator is placed adjacent one of the loops so as to couple one loop to the other through the resonator and to cause the resonator to operate in its dominant mode. The circuit board is constructed by forming conductors separated by insulating material on a ceramic substrate.

11 Claims, 8 Drawing Figures

DIELECTRIC RESONATOR FREQUENCY SELECTIVE NETWORK

BACKGROUND OF THE INVENTION

This application relates to frequency selective networks for microwave circuits, particularly those employing dielectric resonators.

Frequency selective networks for microwave circuits have been constructed employing as a resonator a piece of material having a relatively high dielectric constant, the resonator being coupled to associated circuitry by a pair of input and output coupling loops. The shape of the resonator is typically a disc, one coupling loop being disposed adjacent one flat side of the disc, and the other coupling loop being disposed adjacent the opposite flat side of the disc. In the absence of the disc, the two loops would be decoupled by virtue of the spacing between them; however, they are coupled to one another through the disc. In such a network, which may be used as the frequency sensitive portion of an oscillator or as a band pass filter, the piece of dielectric material functions like a cavity resonator.

Such networks are desirable in many applications because, due to the high dielectric constant of the dielectric resonator, they can be constructed with small physical dimensions relative to their resonant frequency, and because they provide a high Q (quality factor) device. However, conventional construction of such a device requires that the coupling loops, which are typically conductors formed in a circuit board, be placed in separate circuit boards located on opposite sides of the resonator. This introduces undesirable physical separation of electronic components and undesirable mechanical packaging requirements for associated microwave circuitry.

It would be desirable to construct such a network whereby the coupling loops are formed in a single circuit board, thereby simplifying both the electrical and physical design for the associated circuitry.

SUMMARY OF THE INVENTION

The present invention provides a dielectric resonator frequency selective network and method whereby input and output coupling loops may be constructed in a single circuit board. The two loops are placed in substantially parallel planes overlapping one another such that they are substantially decoupled by virtue of their respective electric field patterns. A dielectric resonator is placed adjacent one of the two loops, therey altering the field patterns such that the loops are coupled to one another through the resonator. The geometric center of the resonator is disposed over the geometric center of the overlapping portions of the two loops so as to cause the resonator to operate in the dominant mode of oscillation, that is, the $TE_{01\delta}$ mode.

The network is mounted in a shielded enclosure along with associated microwave circuitry, the single circuit board containing the coupling loops also providing a mounting for the associated circuitry, and the dielectric resonator being suspended over the circuit board by an insulator.

The circuit board is constructed by depositing a conductor such as gold on a substrate such as an aluminum oxide ceramic, covering the first conductor with an insulator such as polyimid, and depositing a second conductor on the insulator.

Therefore it is a principal objective of the present invention to provide a novel dielectric resonator frequency selective network for microwave circuits and method of construction of same.

It is another principal objective of the present invention to provide such a network wherein a pair of dielectric resonator coupling loops may be constructed in a single circuit board.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1A:
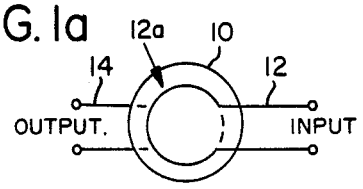
FIG. 1*a* represents a top, diagramatic view of a prior art dielectric resonator frequency selective network.
Figure 1B:
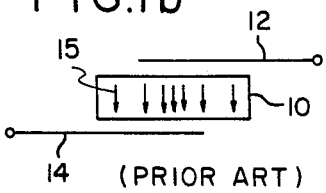
(PRIOR ART) FIG. 1b
FIG. 1*b* shows a side, diagramatic view of a prior art dielectric resonator frequency selective network.

Referring to FIGS. 1*a* and 1*b*, a conventional dielectric resonator frequency selective network typically comprises a disc-shaped dielectric resonator 10 sandwiched between an input coupling loop 12 and an output coupling loop 14. The dielectric resonator is ordinarily a monolithic piece of material having a relatively high dielectric constant, e.g., 38.5, such as barium tetratitanate. Each coupling loop ordinarily comprises a conductor which follows a partially circular path formed in one plane, as shown at 12*a* of FIG. 1*a*. The two conductors are disposed in substantially parallel planes such that their respective partially circular portions are substantially superimposed over one another. In this position they would be maximally coupled to one another, but for the distance of their physical separation, which substantially decouples them. However, they are indirectly coupled by the presence between them of the dielectric resonator 10, which alters the electric field patterns associated with the two coupling loops.

Figure 2:
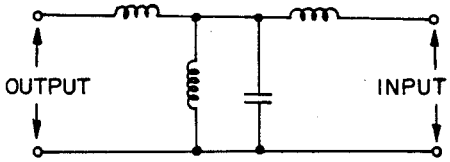
FIG. 2 shows an equivalent circuit for a dielectric resonator frequency selective network.

The dielectric resonator is placed so that its geometric center lies at the geometric center of the two partially circular, overlapping portions of the input and output coupling loops. in this configuration the resonator acts like a cavity resonator operating in the $TE_{01\delta}$ mode of oscillation, as shown by the arrows 15 in FIG. 1*a* representing the electric field within the resonator. The resultant network may be represented by a theoretical equivalent circuit as shown in FIG. 2

Figure 3A:
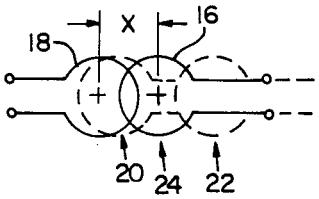
(PRIOR ART) FIG. 3a
FIG. 3*a* shows input and output coupling loops in various moved positions relative to one another.
Figure 3B:
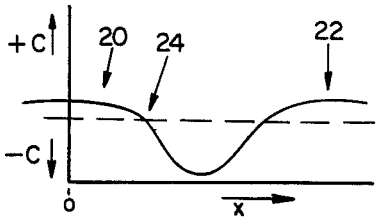
FIG. 3*b* shows a graph of the degree of coupling of the loops in FIG. 3*a* as a function of their relative positions.

Turning now to FIGS. 3*a* and 3*b*, it has been found that where two coupling loops 16 and 18 are placed in two parallel, but closely spaced, planes and moved relative to one another in the two dimensions of those planes, the degree of their coupling C as a function of the separation of their geometric centers X is approximately as shown in FIG. 3*b*. At position 20, where the partially circular portion of the first loop 16 is nearly entirely superimposed over the partially circular position of loop 18, the two loops experience nearly maximum coupling of positive polarity. At position 24, where there is only a slight overlap, the two loops are substantially decoupled from one another. As loop 16 moves away from loop 18 the coupling becomes negative, goes back through zero to a positive peak at position 22 and thereafter drops off toward zero. Thus, the two loops 16 and 18 may be placed at position 24 slightly overlapping one another in parallel planes with minimal separation between the planes, yet be substantially decoupled from one another.

Figure 4B:
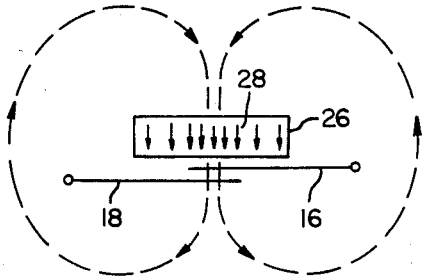
FIG. 4*b* shows a side, diagramatic view of a dielectric resonator frequency selective network according to the present invention.
Figure 4A:
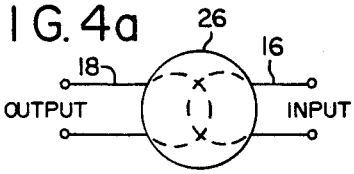
FIG. 4*a* shows a top, diagramatic view of a dielectric resonator frequency selective network according to the present invention.

It has further been found that where the loops are in the relative relationship represented by position 24 the placement of a dielectric resonator 26 adjacent one side of one such loop, as shown in FIGS. 4*a* and 4*b*, with the geometric center of the resonator over the geometric center of the overlapping portions of the two loops, alters the field patterns of the respective loops such that the loops are each coupled to the dielectric resonator and, through the resonator, to one another, as shown in FIG. 4*b*. In this position, the maximum electric flux density is centered over the geometric center of overlapping portions of the two coupling loops so that the resonator operates in the $TE_{01\delta}$ mode, as represented by the arrows 28 in FIG. 4*b*. This is the dominant, and usually most desirable, mode of operation of the resonator. However, it is to be recognized that other desirable modes of operation of the resonator might be achieved by slightly different relative positioning of the resonator and the centers of the loops without departing from the principles of this invention.

Figure 5:
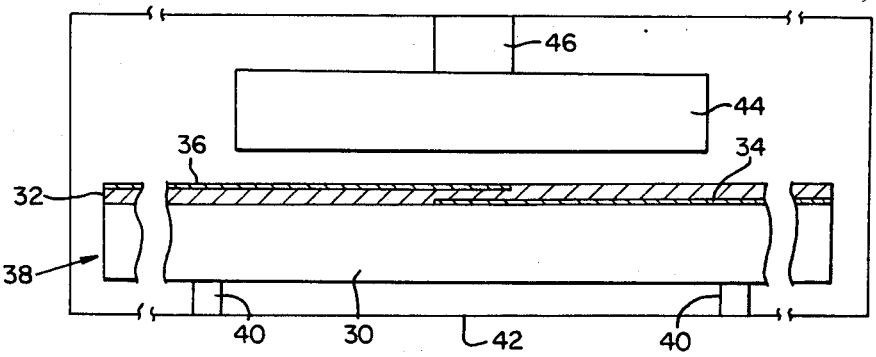
FIG. 5 shows a side section of an exemplary application of a dielectric resonator according to the present invention.

The afore-described novel configuration permits both coupling loops 16 and 18, for input to and output from the resonator, to be constructed in a single circuit board. FIG. 5 shows an example of a preferred embodiment of a typical application. A substrate 30 is formed of an aluminum oxide ceramic. A first conductor, forming a first coupling loop 34, is then placed on the substrate by deposition of evaporated gold. An insulating material 32 such as polyimid is placed on the circuit board over the first conductor, and a second conductor, forming the other coupling loop 36, is placed on the polyimid by deposition of evaporated gold. Typically, the spacing between the first and second coupling loops 34 and 36 would be on the order of about 10 mils. This results in a circuit board 38 into which other conductors may be combined for construction of associated microwave circuitry.

The circuit board 38 is mounted on insulating standards 40 inside a shielded enclosure 42. The dielectric resonator 44, in the shape of a disc formed of barium tetratitanate, is suspended from the top of the enclosure by an insulator 46 made of a suitable low loss material such as cross-linked polystyrene. Preferably, the resonator is spaced from the circuit board by about 100 mils. Such a configuration can be used, for example, to construct a microwave oscillator, the resonator providing the frequency sensitive element, or as a microwave bandpass filter.

The terms and expressions which have been employed in the foregoing specification are used therein as terms of description and not of limitation, and there is no intention of the use of such terms and expressions of excluding equivalents of the features shown and described or portions thereof, it being recognized that the scope of the inventon is defined and limited only by the claims which follow.

I claim:

1. A frequency selectively network, comprising:

(a) a first coupling loop lying in a first plane;

(b) a second coupling loop lying in a second plane substantially parallel to said first plane, said second coupling loop being disposed so as to overlap partially said first coupling loop and be substantially decoupled therefrom as a result of the relative positions of the geometric centers of said loops within the two dimensions of the two planes; and (c) a dielectric resonator disposed adjacent one said coupling loop such that a predetermined portion of said resonator is proximate the geometric center of the overlapping portions of said first and second coupling loops, both said coupling loops being disposed on the same side of said dielectric resonator.

2. The network of claim 1 wherein said predetermined portion of said resonator is the geometric center thereof.

3. The network of claim 2 wherein both said coupling loops comprise conductors disposed within a single circuit board and insulated from one another.

4. The network of claim 3 wherein said circuit board and resonator are disposed within an electrically shielded enclosure, the resonator being mounted at a predetermined distance from the circuit board.

5. The network of claim 3 wherein said circuit board comprises a substrate of aluminum oxide ceramic, the loops comprise gold conductors, and the loops are separated from one another by a polyimid insulating material.

6. The network of claim 1 wherein said dielectric resonator comprises barium tetratitanate.

7. The network of claim 1 wherein each said loop comprises a conductor, a portion of which forms a part of a circle, and said dielectric resonator is disc-shaped, a flat side of the disc being parallel to the loops.

8. A method of manufacturing a frequency selective network comprising:

(a) depositing a first conductor in the form of a coupling loop on an insulative substrate;

(b) placing an insulating material over said first conductor;

(c) depositing a second conductor in the form of a coupling loop on said insulating material parallel to said first conductor so as to partially overlap said first conductor, said first and second conductors being decoupled from each other; and (d) placing a dielectric resonator having a flat face adjacent and parallel to said second conductor to couple said first and second conductors together.

9. The method of claim 8 wherein said substrate comprises an aluminum oxide ceramic, said conductors are deposited by evaporation of gold, and said insulation material is polyimid.

10. The method of claim 9 wherein said dielectric material is barium tetratitanate.

11. A method as recited in claim 8 further comprising:

(e) insulatively mounting said substrate and dielectric resonator within an electrically shielded enclosure, said dielectric resonator being mounted at a predetermined distance from said substrate.

* * * * *